US005820540A

United States Patent [19]

Bohn et al.

[11] Patent Number: 5,820,540

[45] Date of Patent: Oct. 13, 1998

[54] FOLDING APPARATUS FOR SHEET LAYERS

[75] Inventors: Martin Bohn, Reutlingen; Wolfgang Scheller, Oberpleichfeld, both of Germany

[73] Assignee: Bielomatik Leuze GmbH & Co., Germany

[21] Appl. No.: 409,504

[22] Filed: Mar. 23, 1995

[30] Foreign Application Priority Data

Apr. 15, 1994 [DE] Germany ..... 44 13 008.2

[51] Int. Cl.[6] ..... B31F 1/18

[52] U.S. Cl. ..... 493/438; 493/248; 493/443; 493/446; 493/456

[58] Field of Search ..... 493/438, 439, 493/440, 442, 443, 446, 455, 456, 248, 178, 179

[56] References Cited

U.S. PATENT DOCUMENTS

| | | | |
|---|---|---|---|
| 842,823 | 1/1907 | White | 493/442 |
| 2,009,857 | 7/1935 | Potdevin . | |
| 3,288,037 | 11/1966 | Burnett | 493/446 |
| 3,913,464 | 10/1975 | Flaum | 493/179 |
| 3,917,255 | 11/1975 | Watrous | 493/440 |
| 4,008,650 | 2/1977 | Alter et al. | 493/241 |
| 4,016,808 | 4/1977 | Young . | |
| 4,041,849 | 8/1977 | Tsukasaki | 493/442 |
| 4,175,478 | 11/1979 | Tripler | 493/248 |
| 4,290,763 | 9/1981 | Hurst | 493/341 |
| 4,338,085 | 7/1982 | Sullivan et al. | 493/254 |
| 4,425,111 | 1/1984 | Chazelas | 493/438 |
| 4,508,529 | 4/1985 | Feldkämper | 493/438 |
| 4,540,390 | 9/1985 | Thorschmidt . | |
| 4,557,715 | 12/1985 | Robinson | 493/244 |
| 4,792,325 | 12/1988 | Schmidtke | 493/438 |
| 4,915,679 | 4/1990 | Gotou . | |
| 5,037,368 | 8/1991 | Breton et al. | 493/439 |
| 5,094,658 | 3/1992 | Smithe et al. | 493/438 |
| 5,112,291 | 5/1992 | Ver Mehren | 493/438 |

FOREIGN PATENT DOCUMENTS

| | | |
|---|---|---|
| 0 502 687 A1 | 9/1992 | European Pat. Off. . |
| 3916254 | 11/1990 | Germany . |
| 3935056 | 6/1991 | Germany . |

*Primary Examiner*—Michael J. Carone
*Assistant Examiner*—Darren Ark
*Attorney, Agent, or Firm*—Quarles & Brady

[57] ABSTRACT

Folding stations are provided successively in a single running direction of an apparatus for the single or z-like folding of lateral tongues of a sheet layer. The first station has an offset rising folding curve for tongue straightening, the second station has a rotating roll for z-shaped prefolding of a tongue, and the third station has juxtaposed folding curves for the finish folding of differently long tongues and the first pressing rolls for the smoothing of the fold breaks. Therefore, very different and complicated folds can be carefully made in a single pass through the apparatus.

24 Claims, 6 Drawing Sheets

FOLDING APPARATUS FOR SHEET LAYERS

BACKGROUND OF THE INVENTION

The invention relates to an apparatus with which sheet layers or similar blanks can be folded in such a way that two or more folding legs can be transferred from an approximately equiplanar starting position into a relative position diverging therefrom, e.g. into a crosswise or planoparallel relative position. The two folding legs are appropriately interconnected by means of a folding zone made from the same flat material constructed in one piece therewith and which in the manner of a film hinge can form a linear folding break and can be determined by cross-sectional weakening of the material. Such a linear cross-sectional weakening can be e.g. a stamping, a waste-free slitting or perforation, etc., so that the bending rigidity of the material in the vicinity of the folding zone is weakened compared with the connecting areas of the folding legs or the entire folding legs.

Appropriately for this purpose the sheet layer is guided in a not yet separated connection with an endless web and/or successive sheet layers unconnected in a row in an approximately horizontal or other conveying plane and a marginal area located on the particular longitudinal side is engaged with a bearing surface rising from the conveying plane, so that said marginal area forms one folding leg or a strip or tongue-like folding part, whereas the sheet layer part remaining in the conveying plane forms the other folding leg. The folding part can be folded by less or more than 90° or in random manner up to approximately 180°, so that it then coincides with the other folding leg, the folding zone being approximately parallel to the conveying direction, so that there is a progressive swinging of the folding part in the conveying direction accompanied by a continuous off-set deformation until the folding part is again located in a single plane. The folding part with its flat side directed in the swinging direction and/or diverging therefrom engages under pressure on one or more bearing surfaces constructed as folding curves, so that a positive forced fold is obtained.

If the folding curve is formed by a round bar curved in its longitudinal direction, then there is only a linear or a cross-sectionally only punctiform engagement of the folding leg. In the case of numerous materials this can lead to an imprecise folding, to wear damage on the folding leg and to further or similar disadvantages even if a ledge-like folding knife engages in the inside of the folding zone.

SUMMARY OF THE INVENTION

An object of the invention is to provide a folding apparatus for sheet layers, in which disadvantages of known constructions or of the described nature are avoided and which in particular ensures a very precise and low-wear folding in the case of a high folding speed. To this extent the sheet layer is to provide a folded finished product with multiple precise folds.

According to the invention means are provided in order to guide the folding leg, particularly the folding part, in cross-section transversely or at right angles to the conveying direction on more than a single punctiform point. For example the folding leg can be guided on two or more spaced engagement points positioned transversely to the conveying direction and/or in the conveying direction under a contact pressure greater than the weight pressure of the sheet layer. Instead of a punctiform guidance it is possible to provide a larger surface guidance. The guide can be connected to the folding zone or on the freely projecting end of the folding leg, be located between said areas or extend uninterruptedly from the folding zone to the leg end. Two different types of such engagements can be successively provided in the conveying direction.

According to the invention the bearing, supporting or curve surface or the bearing body forming the bearing surface can cross-sectionally have a shape diverging from the circular or pitch circular shape, although the supporting surface can cross-sectionally also be flat curved, e.g. have a radius of curvature of more than 20 mm. However, it is advantageous for the supporting surface in cross-section to be approximately planar, its gradient with respect to the conveying plane being approximately continuous in the conveying direction or changing in the manner of a finely articulated polygonal curve in smaller steps and in the same direction, e.g. by approximately 1 radian/mm. As a result the supporting surface can be formed by machining and with the advance direction at right angles to the conveying direction in individual successive steps or linear zones in the conveying direction.

These or other finishing procedures also ensures that between adjacent linear zones are created comb zones positioned transversely to the conveying direction, projecting only by fractions of a millimeter and being continuous over the contact width and on which engages the folding leg, while it only engages with a much smaller pressure or not at all in the areas located between these protuberances and which are wider than the latter, so that between these areas and the associated side of the folding leg air cushions can form. This leads to an extremely small sliding friction, which counteracts the tendency for the folding zone to diverge from the predetermined orientation and position, e.g. to be inclined with respect to the conveying direction.

For bringing about the relative movement between the sheet layer and the apparatus base the effective supporting surface could also be moved in operation, but is appropriately so fixed with respect to the apparatus base that only the sheet layer in the conveying direction performs the movement necessary for folding. In spite of this the supporting or folding body having the supporting surface can perform a working movement, e.g. a rotary movement with respect to the apparatus base and which assists the folding process. If as a result in the vicinity of the engagement in the folding leg the supporting surface moves approximately parallel to the conveying direction or even roughly synchronously following the folding leg, then a substantially sliding friction-free engagement can be obtained.

It is also advantageous if at least one folding leg during or approximately following on to the start and/or finish of the folding process or in an intermediate area is supported on both longitudinal sides in one of the aforementioned manners. Appropriately e.g. the folding leg is supported on both remote leg sides, if between its folding zone and its leg end is to be produced at least one further fold about at least one further zone, optionally with moving folding curves. This folding could take place with the folding leg positioned in the conveying plane, but the folding leg is initially oriented by approximately 90° from the conveying plane and then at a point following in the conveying direction the further fold is produced or prefolded and at a further following point both or all the folds are finish folded, e.g. in such a way that the three or more folding legs are approximately parallel superimposed. During the straightening and finish folding the folding part can only be supported on its outside. If the folding leg is folded again, only the folding part located at its outermost end is supported at its fold outside and in this way the following folding part is finish folded as an intermediate layer of the outermost fold parts. Thus, for such folds no folding knife is required, although at the end of the straightening of the folding leg it can be supported with its inside by a bearing surface in the above-described manner.

As a result of the described, further folding of the folding leg, in which the inner folding part connected onto the conveying plane is directed inwards towards the centre of the sheet layer and the next connecting folding part is oppositely outwardly directed, the extensible narrow or side wall of a pocket according to the invention can be created, particularly if the fold outside of the outer folding part is flat connected with that of a further folding part, which is provided on a portion of the sheet layer initially adjacent in the conveying direction and which in turn has been placed by transverse folding on the multiply folded folding leg.

According to the invention on the same sheet layer, in the longitudinal direction, in spaced succeeding manner, cross-sectionally identical or non-identical longitudinal folds or folding parts can at least partly be produced with the same bearing or curve surfaces in a single pass and in directly succeeding manner. In particular these folding parts can be straightened with the same folding curve. Cross-sectionally shorter folding legs can then be made by a further folding station without any significant deformation in which only the longer folding legs undergo a further deformation. In a further, directly following folding station the longer and shorter folding legs can be further or finish folded and appropriately the longer folding legs are guide along a continuous folding curve, whereas the shorter folding legs are initially folded a portion further inwards at an intermediate curve until they then run up onto an associated end portion of the continuous folding curve for the longer leg and are finish folded by it. In the conveying direction the intermediate curve can be positioned between the ends of the folding curve for the other or longer folding legs and ensures that the shorter folding leg does not run up in flush manner with its terminal edge onto the folding curve for the longer leg. Therefore the two folding curves are appropriately adjacent to one another transversely to the conveying direction or conveying plane.

Independently of the described constructions the folding apparatus can form with the said surfaces guide means for the sheet layers or the like in the form of a subassembly installable as a whole, which is to be placed on the base frame of a folding device in easily detachable or replaceable non-destructive manner. The folding apparatus can be provided together with further folding apparatuses or can be transversely adjustable to the conveying direction and parallel to the conveying plane, so that the inventive folding apparatus can operate in multiuse manner, i.e. two or more juxtaposed sheet layers or webs can be processed by it. The laterally outermost folding apparatuses only act on the laterally outermost folding parts of the laterally outer sheet layers, whereas the in each case interposed folding apparatus simultaneously works on the facing folding parts of two adjacent sheet layers. All the folding apparatuses appropriately form a preassembled assembly, which as a whole including the transverse adjustment and in common with a partial frame of the base frame is easily detachable from its bottom part. The base frame is to be installed in an easily detachable or replaceable manner on a mount once again in the form of a preassembled subassembly and optionally including the particular folding apparatus, said mount being located on a foundation floor. Advantageously the particular subassembly is insertable and removable transversely to the conveying plane, at right angles to the conveying plane and/or transversely to the conveying direction, it being guided in guides in the manner of a slide.

In the conveying direction upstream and downstream of the folding device are provided further devices for working sheet layers on the mount, the base frames of said devices being constructed or installable in the same way as that of the folding device and for said base frame are provided on the mount identical receptacles, so that a random interchange of the individual devices is possible. In the conveying direction upstream of the folding apparatus layer web is appropriately supplied from a reel storage means and then successively supplied to a driven conveying mechanism, longitudinal cutting devices and devices for producing longitudinal and/or transverse stampings or perforations for folding zones, after which the layer web passes through the longitudinal folding apparatuses. In the conveying direction following the folding apparatus the layer web passes through a further conveying mechanism, so that in all the devices between the two conveying mechanisms, i.e. also in the folding device, it is held under a predetermined tension. Therefore the layer web can drive guidance or pressing members, such as rollers extending over the web width or much shorter rolls, which are e.g. provided at the outlet of the folding apparatus following the final folding curve, in order to press the succeeding folding legs against one another and consequently engage them in flat manner up to the folding zone. Following the second conveying mechanism the individual sheet layers can be separated in further devices initially by cross-cuts from the layer web, then transversely folded in glued form and then the folding parts can be fixed together in the described manner by junctions, such as adhesive joints.

Thus, e.g. from a single blank it is possible to form a pocket with two succeeding, separate pocket compartments, whereof one has the extensible walls on the narrow sides, being connected by its rear wall and via transverse folds to a protective cover for both pocket compartments and is connected by it front wall via a transverse fold to the rear wall of the further pocket compartment located on the outside of said front wall and which is laterally closed with single folding parts and whose front wall in the vicinity of the associated pocket opening and in lateral spacing between its lateral ends can be secured in easily detachable manner with respect to the rear wall with a plug in or tongue closure. After swinging up the protective cover the two pocket compartments can be rendered easily accessible on the inside of said cover, the pocket openings being directed in the same direction and are transversely reciprocally displaced and in which the front pocket opening is always recloseable or relockable after each opening operation.

DETAILED DESCRIPTION OF THE PREFERRED EMBODIMENTS

Figures 1, 5:
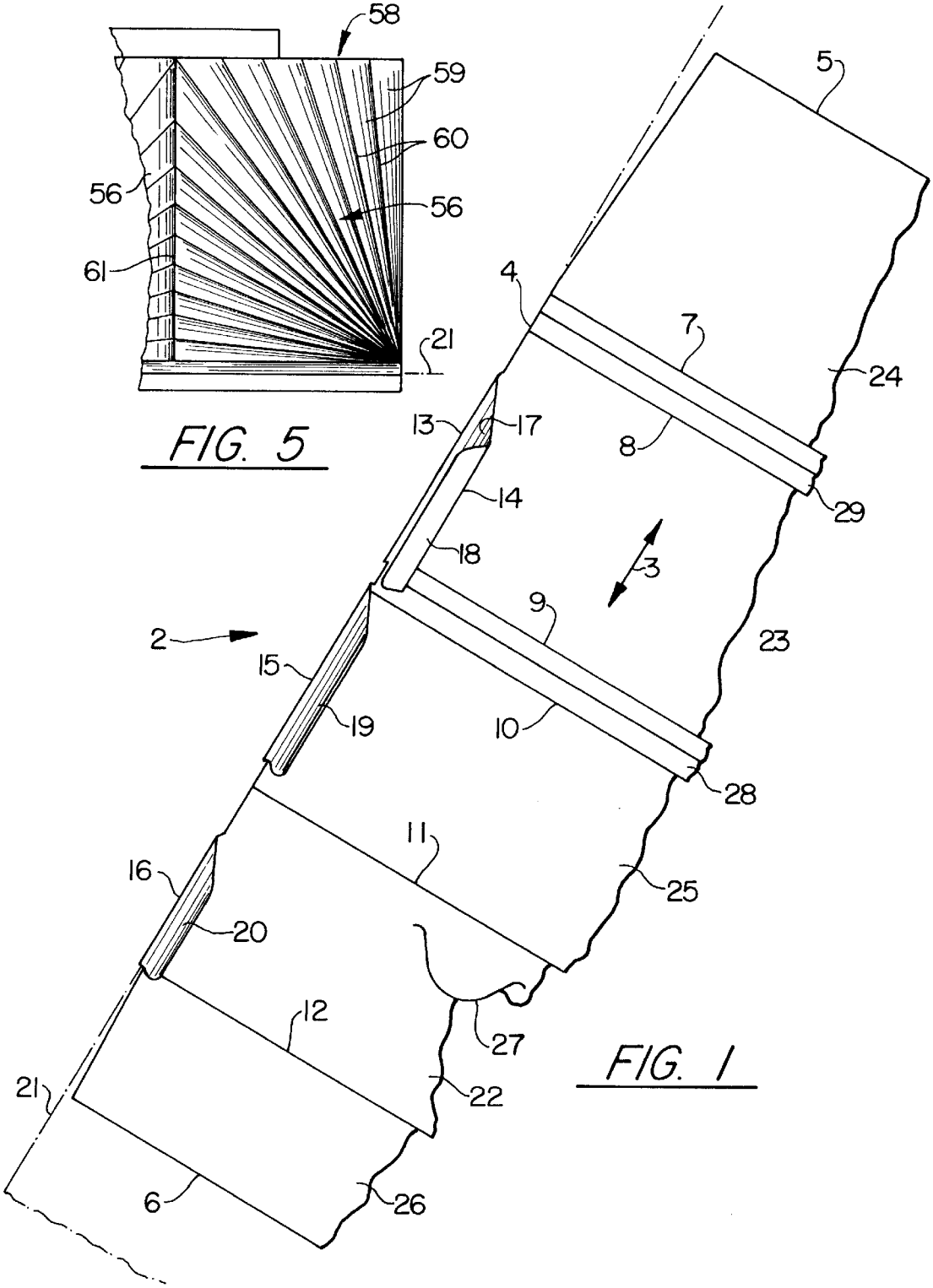
FIG. 1 shows a detail of a sheet layer to be folded with the folding apparatus in perspective view.
FIG. 5 shows a folding curve of the folding apparatus seen in the conveying direction.
Figure 2:
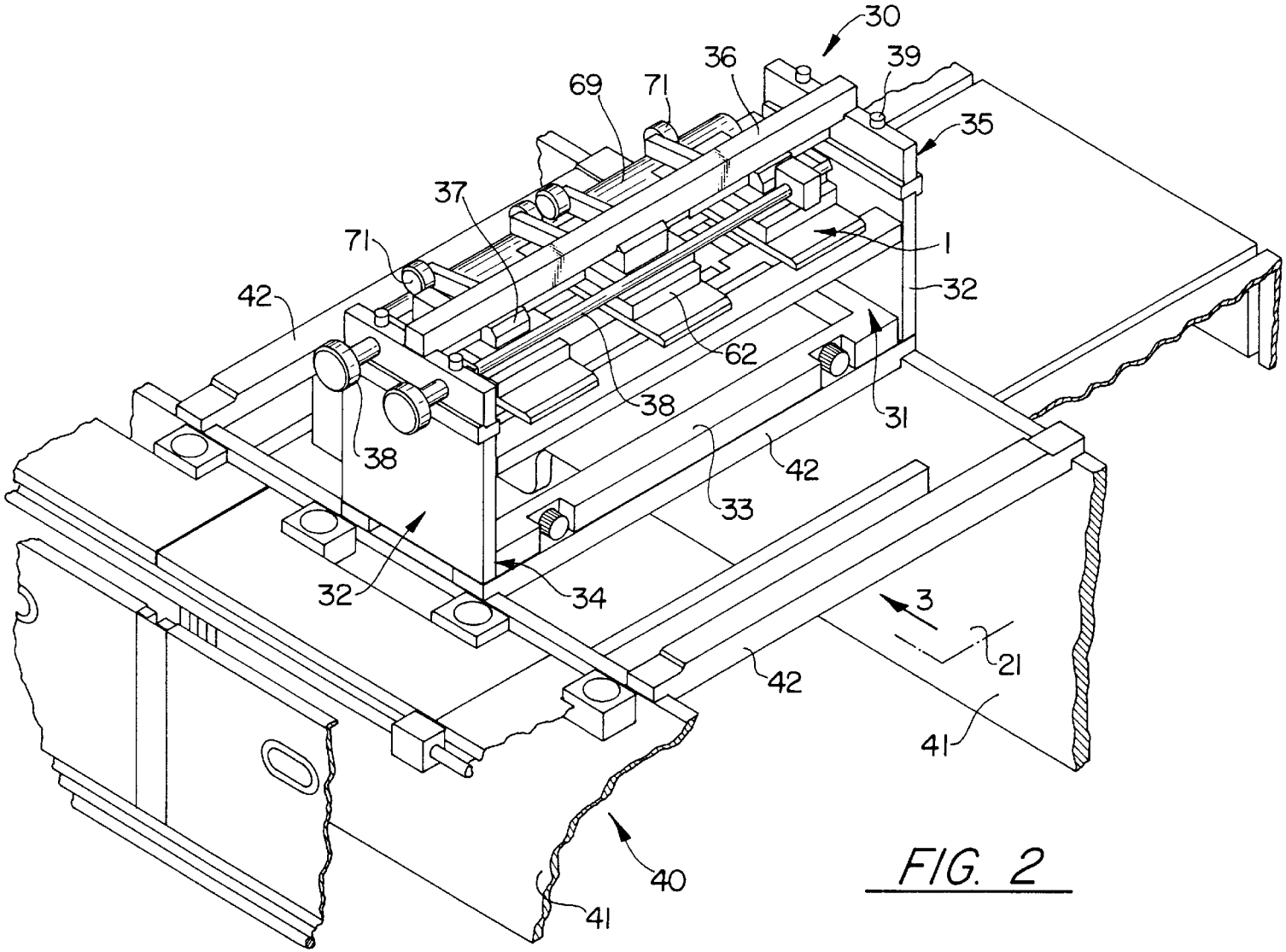
FIG. 2 shows a folding apparatus according to the invention on a mount in a perspective view.

Multiple folding apparatuses 1 juxtaposed in a folding device 30 as shown in FIG. 2 are used for folding a sheet layer, or blank, sheet layer 2 is conveyed on a 2 shown in FIG. 1, sheet layer 2 is conveyed on a web in its longitudinal direction 3 and during the continuous passage is folded at its lateral longitudinal edges 4. The sheet layer 2 is then separated from the layer web at its remote terminal edges 5, 6, transversely positioned with respect to the conveying direction 3. During conveying each of the two terminal edges 5, 6 can lead or trail. Following the longitudinal folding, several transverse folds are made around the folding zones 7 to 12, which are spaced from one another and spaced from the terminal edges 5, 6 and subdivide the sheet layer over its entire length into individual length portions or wall parts.

On each of the two longitudinal edges 4 are provided folding zones 13 to 16 arranged in spaced succession in the direction 3 and juxtaposed transversely to the direction 3 for forming folding legs 17 to 20, in which two longitudinal edges 4 are substantially mirror-symmetrically and identically constructed. At a sheet layer 2 spread out prior to entering the apparatus 1, 30 in a surface or conveying plane 21, the folding legs 17 to 20 project laterally by their leg height over the associated lateral edge 4, the folding zones 13, 15, 16 coinciding roughly with the longitudinal edge 4, whereas the folding zone 14 is laterally outwardly displaced with respect thereto. The folding zones 17, 19, 20 are folded upwards over the longitudinal edge 4 and inwards on the top of the remaining sheet layer 2, whereas the folding leg 18 connected to the outer end of the folding leg 17 via the folding zone 14 is folded in the opposite direction, namely on the outside of the leg 17 and directed towards the associated longitudinal edge 4, so that its leg inside then comes to rest on the leg outside of the folding leg 17.

The wall parts 22 to 26, 28, 29 located between the terminal edges 5, 6 in each case form those folding legs, which during the folding process remain in the conveying plane 21 and are pivoted with respect to that of the remaining folding legs 17 to 20. The folding leg carrying the folding legs 17, 18 forms the rear wall 23 of a folding pocket and the folding leg carrying the folding leg 19 forms the front wall 25 of the folding pocket, accessible only at one transverse side and extending approximately over the width of the sheet layer 2 and whose side walls are formed by the approximately congruently interconnected folding legs 17 to 19. The leg outside of the folding leg 18 connected to the leg inside of the folding leg 17 is connected by adhesion to the outside of the folding leg 19, so that the strip-like side wall 17 to 19 is continuously modified in its width in the manner of a bellows and can therefore reversibly adapt to the size of the pocket content.

The rear wall 23 and the front wall 25 located upstream of its inside are connected to one another by a strip-like bottom 28 connected in one piece thereto and located between the associated folding zones 9, 10 and whose width can roughly correspond to the greatest width of the side walls 17 to 19. Roughly in the center between the folding zones 9, 10 can be provided a further folding zone, so that the bottom 28 is also folded flat in at least double layer manner and can be reversibly widened in the aforementioned manner. A protective cover 24 is connected to the end of the rear wall 23 remote from the bottom 28 via the folding zones 7, 8 which form a cover wall 29 located between them. A protective cover 24, can be folded over and beyond said opening on the outside of the front wall 25 for closing the pocket opening of the pocket 23, 25, 28. The pocket opening then covers the cover wall 29, which is then reversibly widen ably constructed and dimensioned in the same way as the bottom 28. An additional front pocket is connected to the end of the front wall 25 remote from the rear wall 23 by means of the folding zone 11. The rear wall 22 of the additional front pocket, which like the outside of the rear wall 22 engages on the outside of the front wall 25. The front wall 26 of the front pocket is connected to the end of the rear wall 22 remote from the folding zone 11 via the folding zone 12.

The rear wall 22 is provided with the folding legs 20, to whose outsides is fixed the front wall 26 by its lateral outer marginal zones by adhesion or the like. The front wall 26 has a smaller height than the rear wall 22 and the rear wall 22 has a smaller height than the front wall 25. From the rear wall 22 is punched a tongue-like, bending elastic locking flap or tongue 27 projecting toward the folding zone 12 and under which can be shoved the marginal area of the front wall 26 abutting the terminal edge 6, so that a product located in the front pocket 22, 26 is prevented from dropping out. The folding legs 17, 18 or 19 are connected without fastening substantially directly to the associated bottom 28 and are spaced from the remote folding zones 8, 11. The folding leg 20 is connected substantially directly to the bottom of the front pocket 22, 26 formed by the folding zone 12, and like the folding leg 19, provided on the front wall 25 is spaced from the folding zone 11 separating the two pocket openings with respect to which the locking tongue 27 is displaced towards the folding zone 12. The cover flap 24 and cover wall 29 consequently close off the front pocket or its pocket opening.

The folding zones 7 to 10, 12, 13, 15, 16, which are all used for folding to the same side of the remaining sheet layer, are appropriately formed through stamping grooves, whereas the folding zones 11, 14 provided for folding in the opposite direction are appropriately formed by slit perforations from spaced succeeding and aligned, short separating cuts. The leg length of the folding leg 17 is appropriately slightly greater than that of the folding legs 19, 20, whereas the length of the folding leg 18 is slightly less than that of the folding legs 17, 19, 20. The folding legs 17, 18, 23 form a so-called Z-fold. The front wall 25 can be slightly lower than the rear wall 23. As a result of the described construction the invention leads to an advantageous folding pocket with several pocket compartments whereof at least one has a variable thickness.

All the longitudinal folds around the folding zones 13 to 16 are produced on a conveying section and in continuous manner by the folding device 30 and said section is smaller than the working width. The device 30 has a dimensionally rigid frame 31 with two plate-like side walls at right angles to the conveying plane and on either side positioned laterally outside the working width and which are rigidly interconnected by means of rod-like crossbars, as well as a frame-like connecting unit 33, which forms the lowermost base of the frame 31 and therefore the carrying standing surface for the folding device 30. The frame 31 is subdivided into two individual frames, namely a base frame 34 having the connecting unit 33 and a partial frame 35, which is connected to the side of the base frame 34 remote from the connecting unit 33 and which like the base frame 34 is dimensionally rigid through crossbars and like said frame 34 forms parts of the side walls 32. As a result the two individual frames 34, 35 can be interconnected substantially exclusively via the side walls 32.

Only the partial frame 35 lower than the base frame carries the folding apparatuses 1 and namely in suspended manner on a crossbar 36 connecting the associated wall parts 32. The two lateral, outer folding apparatuses 1 located below the crossbar 36 and which in each case only make folds on a single longitudinal edge 4, are so mounted on the underside of the crossbar 36 with slide guides 37 that independently of one another they can be continuously adjusted with a servo drive 38 in the transverse direction without changing the position of their conveying plane 21. The central folding apparatus provided for folding in the vicinity of two facing longitudinal edges 4, is also fixed to the crossbar 36, whose ends are in turn supported on the tops of the side walls 32, so that with the side walls it forms a gantry frame and with the folding apparatuses 1 a subassembly easily detachable from the remaining frame 31, 35. The lateral folding apparatuses 1 are located on both sides of a median plane 77' to which all folding apparatuses 1 are substantially mirror-symmetrical.

The two servodrives 38 have on remote sides of the slide guide 37 in each case one adjusting spindle parallel to the adjusting direction and which engages in a corresponding nut on the associated folding apparatus 1, so that adjustment of the entire subassembly with all the associated functional parts is possible. The adjusting spindles traverse the front side wall 32 of the partial frame 35 and carry on the front of the frame 31 a handle, so that it can be operated in easily accessible manner. The individual frames 34, 35 are braced against one another by fastening bolts 39 or the like, which pass through the associated wall parts or the wall edges supported on one another and are accessible at any time from the top of the frame 31.

The folding device 30 is placed in easily detachable manner on a mount 40, which has two plate-like side walls 41 located roughly in the planes of the side walls 32 and which are dimensionally rigidly interconnected by means of crossbars. On the upper plate edges of the side walls 41 are supported by their ends rod-like supports 42, which also form crossbars and are positioned transversely to the direction 3. The supports 42 are positionally variable with respect to the mount 40 parallel to the direction 3 and form with their tops above the upper plate edges of the side walls 41 supporting and bearing surfaces for the folding device 30 positioned parallel to the conveying plane 21. The device 30 is provided in the vicinity of its outsides positioned transversely to the direction 3 with rolls or the like, with which it can be pushed down from the mount 40 laterally forwards or rearwards transversely to the direction 3 and parallel to the plane 21, in the reverse direction can be moved into the working position or can be displaceably adjusted in track-maintaining manner on any planar positioning surface. In the working position the rolls are located in depressions on the bearing surfaces of the supports 42, so that the underside of the connecting unit 33 then rests directly with supporting faces on the bearing faces.

The partial frame 35 can then be raised upwards and/or drawn off parallel to the direction 3 with the folding apparatuses 1 and the servodrives 38 with respect to the base frame 34 left on the mount 40 and then the complete base frame 34 can either be removed upwards or in one of the indicated running directions. This ensures a very favorable maintenance of the individual functional units of the folding device 30. The folding device 30 or the frame 31, 34 can be brought with a trolley or the like to the height of the support 42 and then the supporting or bearing rails of the trolley form extensions of the supporting and bearing rails 42. On the thus extended rails it is possible to move the folding device 30 randomly backwards and forwards and to then move the rails of the trolley for precise orientation purposes appropriately positively detachably engage in positioning members of the mount 40.

The particular folding apparatus 1 has three folding stations 43, 44, 45 in directly succeeding manner for each folding leg 17 to 20 of a longitudinal edge 4. In the first folding station 43 the folding leg is erected by approximately 90° with respect to the conveying plane 21. In the second folding station 44 the folding leg 18 is prefolded in obtuse-angled manner relative to the folding leg 17, while the folding legs 17, 19, 20 are slightly inwardly folded over and beyond 90°. In the third folding station 45 the folding legs 17, 19, 20 are folded completely on the tops or insides of the associated folding legs 23, 25, 22, while the folding leg 18 is folded on the outside of the folding leg 17.

Figure 3:
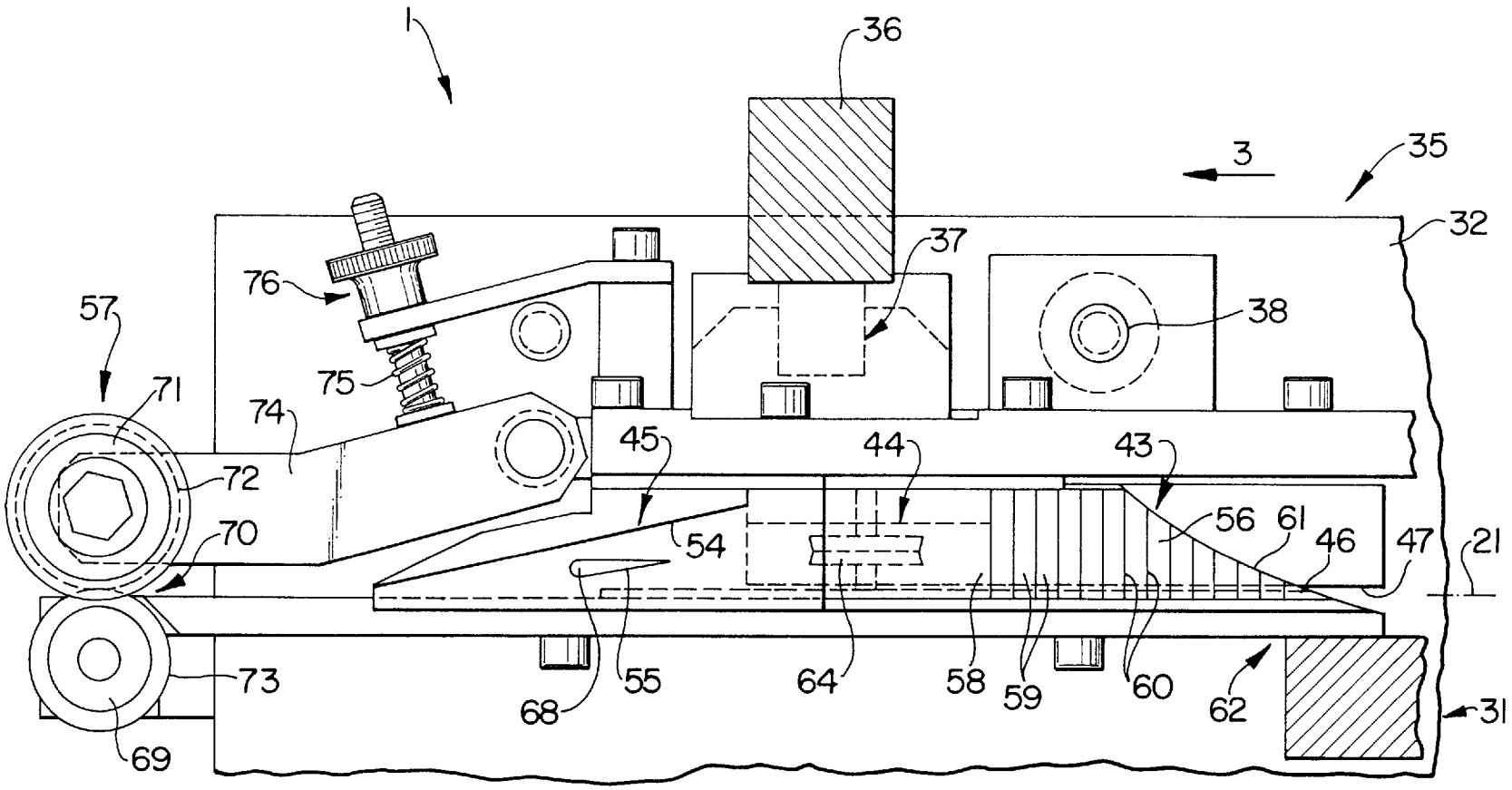
FIG. 3 shows a folding apparatus according to the invention in side view.
Figure 4:
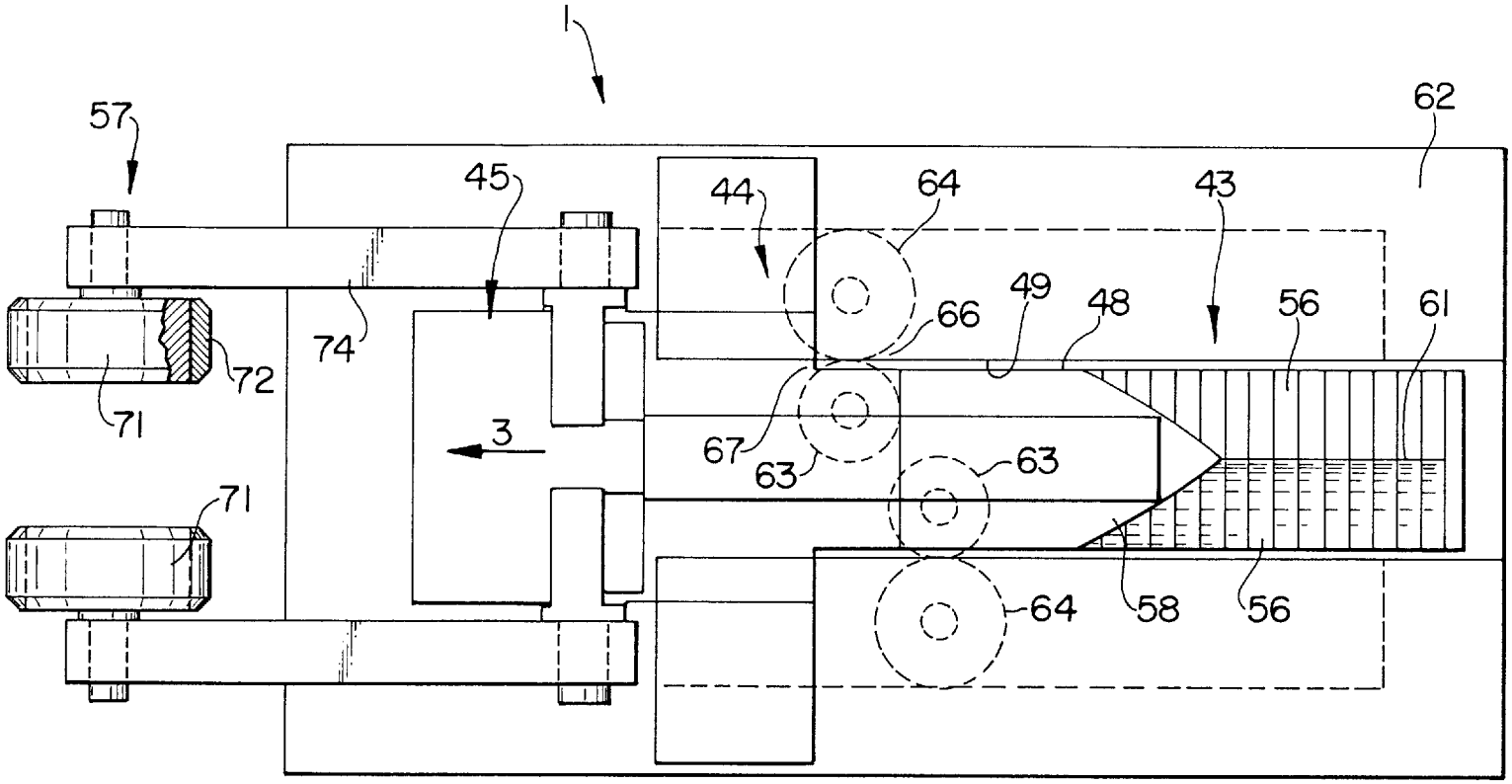
FIG. 4 shows the folding apparatus of FIG. 3 in plan view.

With reference to FIG. 3, the folding stations have bearing surfaces 46 to 56 for securing the position and reciprocally pivoting or swinging the folding legs during the passage. The gap-spaced, parallel bearing surfaces 46, 47 are further apart than the thickness of the sheet layer 2 and are used for guiding the parts 22 to 29 of the sheet layer 2 located in the conveying plane 21 in the particular folding station, so that said part of the sheet layer 2 is always secured against transverse movements in positive manner on both layer sides. The facing bearing surfaces 48, 49 corresponding to and at right angles to the bearing surfaces 46, 47 are used for guiding the folding legs 17 to 20 following straightening in corresponding manner on both sides, said bearing surfaces being only provided at the outlet from the folding station 43 or at the connecting inlet of the folding station 44, but not in the working area of the latter. The bearing surfaces 50 to 53 form a similar, but less angled working gap of the folding station 44 in which the folding legs 17, 18 are inclined against one another. The bearing surface 54 forms a folding curve for the finish folding of the folding legs 17, 18, whereas the folding curve 55 of the folding station 45 closer to the conveying plane 21 forms a folding curve for performing a first partial phase of the finish folding of the folding legs 19, 20, which after leaving said folding curve 55 jump to the next following end portion of the folding curve 54 and are completely folded by the latter. The folding body 68 forming the folding curve 55 only projects to such an extent that it does not prevent the passing by of the prefolded or already partly finish folded folding legs 17, 18 and instead engages in contact-free manner in the corresponding angle between the legs 17, 18. After leaving the folding station 45 the substantially finish folded folding legs 17 to 20 successively pass into a pressing station 57, in which they so pass between pressing bodies, that the folds 13 to 16 are bent sharply or in substantially non-resilient manner. The pressing station 57 forms the outlet of the folding apparatus 1.

For erecting the folding legs 17 to 20 from the conveying plane 21, the folding station 43 provides a bearing surface 56 constructed as a folding curve and which in direction 3 rises in small, constant steps from its position in the conveying plane 21 to a position roughly at right angles to the conveying plane 21 at the outlet of the folding station 43. The folding curve 56 is provided on a folding body 58, which with its offset outer flank forming its top and one lateral face forms the folding curve 56. The two lateral, outer folding apparatuses 1 have in each case a single folding curve, whereas the interposed folding apparatus 1 has two juxtaposed folding curves 56 interconnected along a median line 61 and located remote from one another at the outlet. The juxtaposed folding curves 56 end can be formed by a common folding body 58 or two separate interengaging and mirror-symmetrical folding bodies 58. Folding bodies in the lateral folding apparatuses can be identical to folding bodies 58 used in the central folding apparatus 1.

The folding curve 56 is formed by a plurality of partial surfaces 59. Partial surface 59 are narrow strips of in each case maximum width 3 or 5 mm following on to one another in direction 3 and at right angles to the conveying plane 21. The rise or gradient difference between adjacent partial surfaces 59 is a maximum of 3 or 5 radians, so that on a distance of approximately 90 mm the gradient of the folding curve 56 is over 90°. The associated ends of all the substantially planar partial surfaces 59 extend approximately into the conveying plane 21, whereas the remote ends are located in a comb-like crest 61 of the folding body 58. The crest 61 rises progressively in a concave manner from the starting portion of the folding curve 56. As the crest 61 is located in a plane at right angles to the conveying plane 21 and parallel to the direction 3, the two remote folding curves 56 as shown in FIG. 5 can form a common crest 61. The width of the folding curve 56 is greater than the length of the folding legs 17 to 20, so that the latter are reliably guided over the entire leg length upon erecting. Between adjacent partial surfaces 59 is provided a linear protuberance 60 which is at right angles to the direction 3 and transverse to the conveying plane 21 and which forms the actual sliding surface for the folding legs 17 to 20.

The folding body 58, like the remaining functional parts of the folding apparatus 1 is fixed or mounted on an apparatus base 62, which is rigidly fixed by means of the guide 37 to the frame 31, so that each folding apparatus 1 can be easily detached and replaced independently of the others. The folding body 58 extends into the vicinity of the folding station 44 and forms up to its working area the bearing surface 49 for the inside of the folding legs 17 to 20. Movable parts of the folding station 44 can also be mounted on the folding body 58 and form with the latter a preassembled subassembly.

The folding curves 50 to 53 of the folding station 44 are formed by circumferential surfaces of rolls 63, 64, which e.g. in the form of disk-like rolls are rotatable about positionally rigid spindles, which are parallel to one another, at right angles to the conveying plane 21 and displaced against one another transversely to the direction 3. Each roll 63, 64 has two folding surfaces 50, 51 or 52, 53 at an obtuse angle of more than 120° or approximately 150° to one another in the form of frustum faces, which in each case pass to the associated face of the roll 63, 64. On the circumference of the roll 63 the folding surfaces 50, 51 rise against one another in frustum-shaped manner, so that they are connected or pass into one another in a radially projecting, edge-like ring zone. On the circumference of the other roll 64 the folding surfaces 52, 53 rise radially away from one another in the outwards direction complimentary to the folding surfaces 50, 51, so that in reentrant manner they are V-shaped to one another and in the V-tip form a sharp-edged ring depression The two rotation axes of the rolls 63, 64 are in an axial plane at right angles to the direction 3, the folding surfaces 50, 51 and 52, 53 engage in one another with a gap spacing, which is only slightly larger than the material thickness of the sheet layer 2 or the folding legs 17, 18.

The greatest diameter of the roll 63 located at the projecting ring edge is approximately a quarter smaller than the greatest diameter of the roll 64 located at the ends, so that on the one hand the roll 63 further removed from the median longitudinal plane of the sheet layer 2 can be housed in more space-saving manner and on the other due to the smaller radius of curvature there is a stronger bend action in the working gap between the freely rotatable rolls 63, 64 rotated only by frictional engagement with the folding legs 17, 18. For the more compact housing of the two folding stations 44 of the central folding apparatus 1 these folding stations 44 are slightly reciprocally displaced in direction 3, so that the two rolls 63 located between the folding curves 56 closer to the median longitudinal plane, considered in the direction 3, can engage over one another. The bearing surfaces 50 to 53 of the two rolls 63, 64, as a result of their convex curvature, at the inlet side form a degressively narrowed entry funnel 66 and on the outlet side a progressively widened discharge funnel 67 for the folding legs 17 to 20. Corresponding entry and discharge faces approaching or moving away from the folding leg plane are also conceivable on fixed bearing surfaces and are used for a careful entry and discharge before or after folding. The folding legs 18 can project beyond the folding surfaces 51, 53. The roll 63 can be mounted on the folding body 58. The roll 64 is mounted on an independently installable bearing body or on the base 62.

The folding surfaces 50 to 53 or the rolls 63, 64 are substantially continuously adjustable transversely to the conveying plane 21, e.g. in that on their ends are provided interchangeable spacing members, such as shim rings located in their rotation axes, so that the folding surfaces 50 to 53 can be adapted to the position of the folding zone 14. The folding surfaces 50, 52 closer to and inclined with respect to the conveying plane 21 are also used for the guidance of the folding legs 19, 20, whose length is such that it does not pass into the vicinity of the folding surfaces 51, 53 further removed from and inclined to the conveying plane 21 and can consequently not be engaged by the folding torus engaging in the ring depression. The spacing between the outlet of the folding curve 56 and the working area of the folding station 44 can be chosen in such a way that the folding legs 17 to 20 have already completely left the folding curve 56 before coming into working engagement with the folding station 44 or that at the start of said engagement it is still engaged by its trailing portion with the folding curve 56. The same applies with regards to the spacing between folding stations 44 and 45 or the spacing between the folding station 45 and the pressing station 57.

The bearing surface 54 of the folding station 45 is constructed as a wedge surface sloping away in the direction 3 and which over its entire length in cross-section can be approximately parallel to the conveying plane 21 and falling away approximately up to said plane 21. The folding curve 54 can also be inclined under an angle in the starting area which corresponds to the inclined position of the folding leg 18 as a result of the prefolding in the working station 44 and then the folding curve 54 appropriately passes in said parallel position and by offsetting about an axis which is in a plane at right angles to the conveying plane 21 and parallel to the direction 3 and falls away to the conveying plane 21 corresponding to the acute angled wedge gradient. The folding curve 56 is offset about a corresponding axis located roughly in the conveying plane 21 and in the running area of the folding zones 13, 15, 16, so that adjacent partial surfaces 59 towards their ends remote from the conveying plane 21 assume ever increasing distances along the arc about the offset axis and therefore the height of the protuberances 60 also increase to said ends.

In the offset axis or conveying plane 21 are located partial surfaces 59 and protuberances 60 which are linearly aligned in the direction 3, so that they are continuously connected to one another free from steps or protuberances. In particular for short folding tongues 19, 20 the folding curve 54 can also pass from a plane roughly at right angles to the plane 21 by offsetting in the direction 3 into a position parallel and immediately adjacent to plane 21, whilst having a structure as described with respect to the folding curve 56. No bearing surface directly faces most of the rising portion of the folding curve 56 and the folding curve 54 and this also applies for folding curve 55.

The folding curve 54 directed against the conveying plane 21 faces the folding body 68 with a much greater spacing than the aforementioned gap spacings and in cross-section transversely to the direction 3 it projects in the manner of a freely projecting arm in the direction of the median longitudinal plane 77 of the associated sheet layer 2 and can be fixed by its fixing end in easily detachable and replaceable manner to the base 62 or the folding body forming the folding curve 54. The folding curve 55 dropping in a similar manner to the folding curve 54 and directed against the conveying plane 21 is located with its rear end spaced downstream of the rear end and with its front end at a greater spacing upstream of the front end of the folding curve 54. If the outside of the folding leg 18, sloping away from the conveying plane 21, runs up onto the folding curve 54 immediately after leaving the folding station 44, then by the action of the folding curve 54 the folding legs 17, 18 are folded further around the folding zones 13, 14. The folding leg are folded on their side remote from the median longitudinal plane of the sheet layer 2, in the vicinity of the folding zone 14 bound by a V-shaped depression, so that without contact they can run past the folding body 68 and then engage in this depression. However, the folding legs 19, 20 are initially not in engagement with the folding curve 54, but firstly with the folding curve 55, through which they can be pivoted further inwards about the folding zones 15, 16. After leaving the folding curve 55 the folding legs 19, 20 then engage with the associated end of the folding curve 54, which completely engages them against the folding legs 25, 22.

Figure 6:
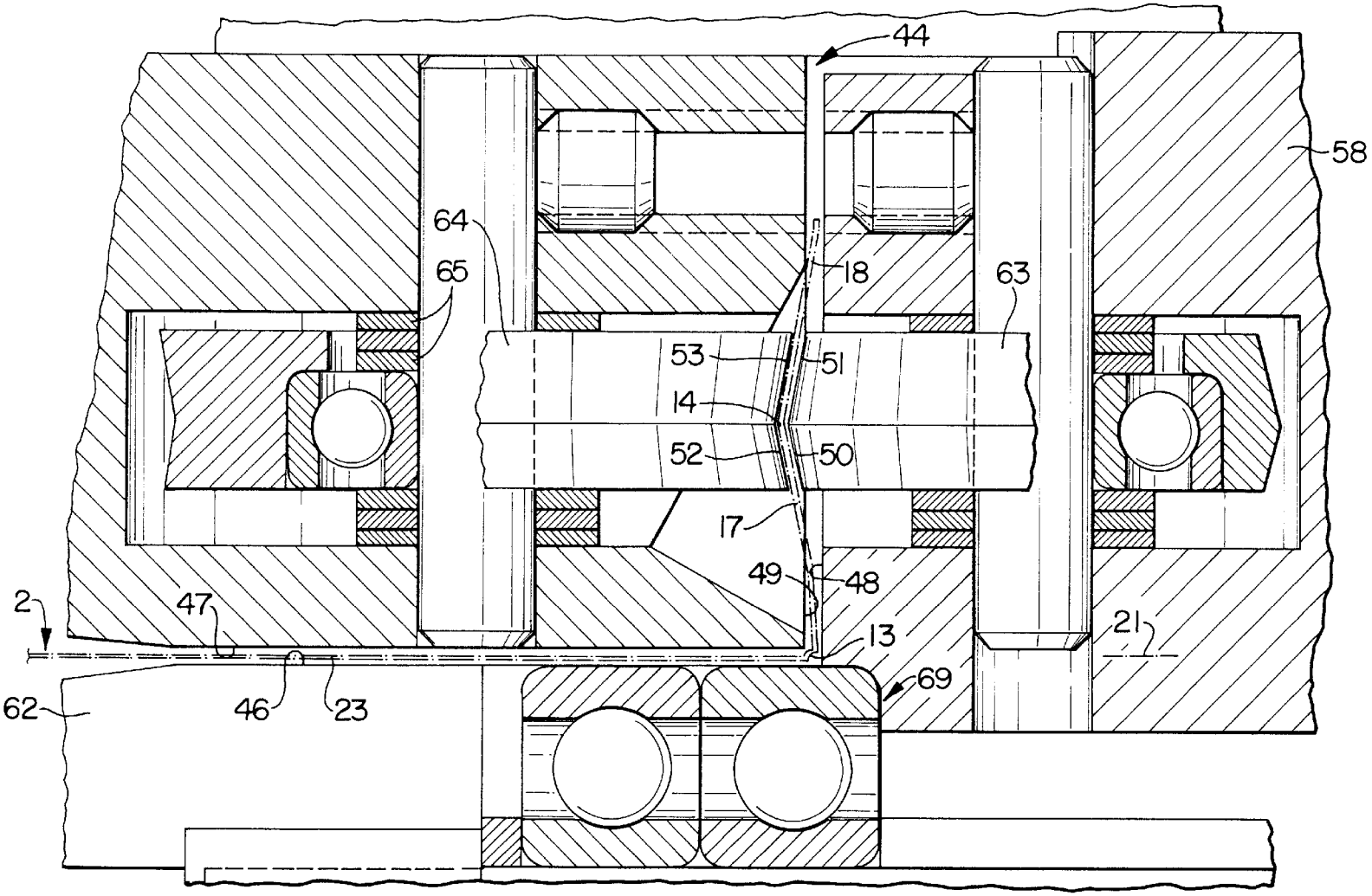
FIG. 6 shows a detail of FIG. 3 in cross-section and on a much larger scale.
Figure 7:
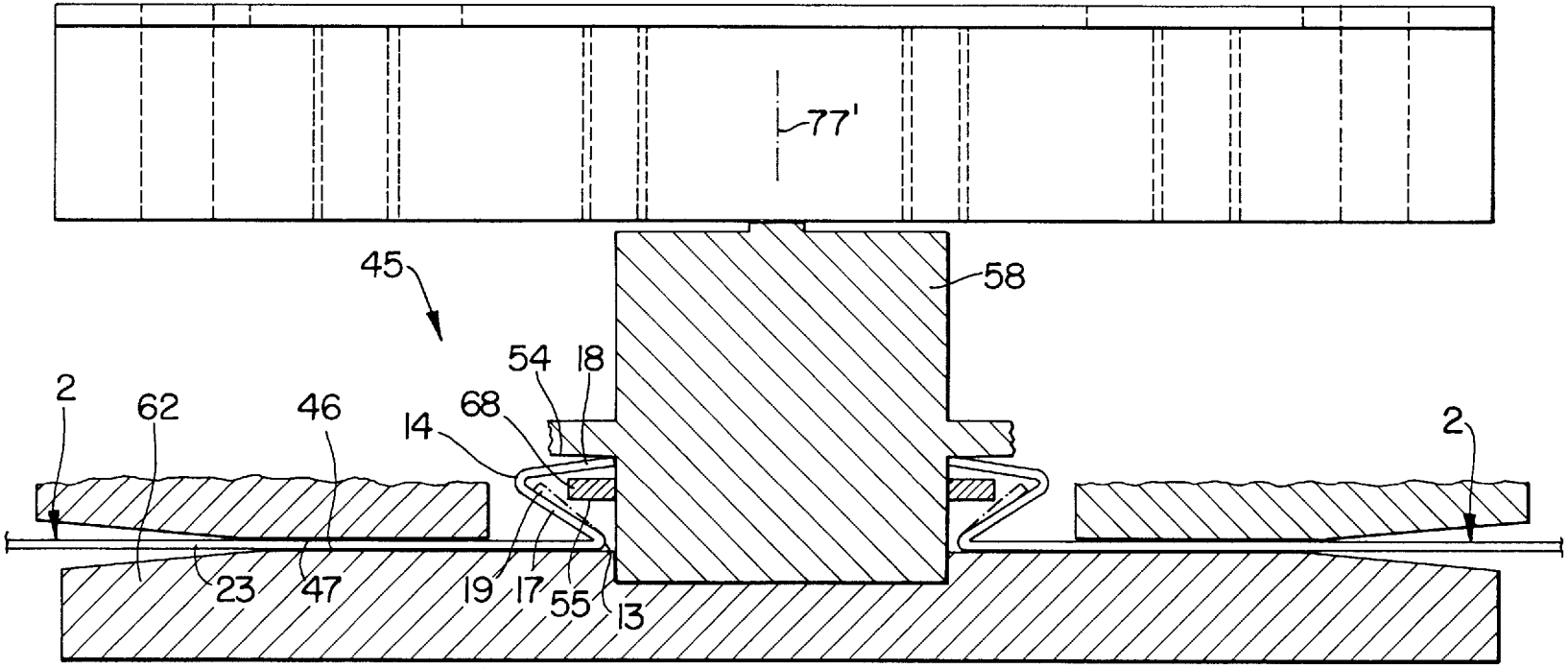
FIG. 7 shows the folding curves of a folding station in cross-section.

The folding station 57 has two rolls 69, 71, which are in direct reciprocal driving engagement by means of a friction drive 70 and which are rotatable about axes at right angles to the direction 3 and parallel to the conveying plane 21 and which are located in a roughly right-angled, parallel axial plane to the direction 3. The circumferential faces of the rolls 69, 71 form pressing surfaces 73, 72, which in the conveying plane 21 press against one another the folding legs 17 to 20, 23, 25, 22. The roll 69, which runs on the side of the folding legs 23, 25, 22 remote from the folding legs 17 to 20, can be mounted with fixed axis on the base 62 and can be formed by a continuous guide roller passing over the working width of the folding apparatus 1 or 30 and which is directly driven by the conveyed layer web 2. By means of the gear 70, whose interengaging gear rolls are located in the axes of the rolls 69, 71, is also driven the roll 71 running on the folding legs 18 to 20. However a reduction ratio is chosen in such a way that the circumferential speeds of the pressing faces 72, 73 differ slightly. For example, the circumferential speed of the pressing face 72 can be slightly greater than that of the pressing face 73, in order to avoid an inclined position of the folding zones 13 to 16 relative to the predetermined orientation. The pressing faces 72, 73 run synchronously in the same direction as the layer web in the working gap. According to FIG. 6, the pressing faces 73 of the roll 69 shown in FIG. 3 can also be directly formed by the circumferential surfaces of the outer rings of ball bearings and project axially in the same way as the pressing faces 72 over both the ends of the folded folding legs 70 to 20 or over and beyond the folding zones 13 to 16.

Each of the rolls 71 is mounted on a separate support arm 74 projecting freely in the direction 3 and which spaced behind the roll 71 is mounted on the base 62 so as to pivot about an axis parallel to its axis and independently of all the adjacent rolls 71. With a spring 75 acting on the arm 74 the roll 71 is pressed by its pressing face 72 against the pressing face 73 and the spring tension of the spring 75 can be manually continuously adjusted by an adjusting means 76. The pressing face 72 of the roll 71 is appropriately formed by a pressure elastic, resilient layer which, due to the pressing action, runs in relatively large-area deformed manner on the folding legs 18 to 20. A separate roll pair 69, 71 is provided for all the folding legs 17 to 20 located on the longitudinal edge 4.

All the indicated characteristics, such as dimensions, position definitions and the like can be provided precisely as described, or substantially as described or significantly varying therefrom. As a result of the process according to the invention there is a very precise working of the sheet layers 2 at a very high working speed. The folding leg length can be of a random nature and in particular below 20, 10 or even 5 mm. By corresponding recessing of the bearing surfaces the folding legs can still be folded when already provided with a glue layer. In addition, continuous folding legs, or, as described, intermittently following folding legs can be folded over a very short folding section at a random speed of up to at least 300 m/min. Different folding apparatuses 1 for different folds can be provided on frame 31.

What is claimed is:

1. An apparatus for fabricating product from at least one sheet blank defining a blank thickness extension and having first and second blank legs, each of the first blank legs comprising an extension of the second blank leg, the first blank legs connecting to the second blank legs along a blank zone said apparatus comprising:

an apparatus base;

means for alternating the shape of the at least one blank, including at least one guiding tool having a plurality of folding faces;

the at least one blank having two separate folding flaps formed by said first blank legs and including higher and shorter folding flaps connected to and spaced along a common lateral leg edge of the second blank leg, the higher folding flap protruding over the leg edge by a longer flap height extension and the shorter folding flap protruding over the leg edge by a shorter flap height extension;

conveying motion defined as a motion direction parallel to a conveying motion defined as a motion; a first folding face being provided for erecting the separate folding flaps with respect to the second blank leg to an erected position, said first folding face connecting to guide faces downstream for holding the separate folding flaps at least partly in the erected position while continuing said conveying motion, said guide faces connecting to a folding gap downstream formed by limited folding faces for further folding only the higher flap while leaving the shorter folding flap in erected position, said folding gap connected to a folding unit downstream including a common second folding face folding both the separate folding flaps onto the second blank leg; and said folding unit having a third folding face for folding and thereby moving the shorter folding flap towards the second blank leg, said second folding face folding the higher folding flap and said third folding face folding the shorter folding flap while separately engaging the two separate folding flaps, said second and third folding faces being juxtaposed transverse to said conveying motion and to a plane of the second blank leg, said third folding face being provided by a folding body, said folding body providing, in cross-section transverse to said conveying motion, a freely projecting arm including a fixed end.

2. The apparatus according to claim 1 wherein said first folding face comprises a plurality of finely distributed contact faces for directly contacting the fist blank leg, said first folding face directly facing and folding the first blank leg with said plurality of finely distributed contact faces defining a folding pitch, a linear extension of at least one of said plurality of finely distributed contact faces being substantially planar in cross-section, said contact faces having a plurality of finely distributed contact protrusions on said tool face for reducing sliding friction of the first blank leg.

3. The apparatus according to claim 1, wherein for simultaneously only punctually contacting the first blank leg in cross-section said first folding face is finely subdivided into face sections including directly interconnected face sections, said interconnected face sections only interconnecting at said plurality of finely distributed contact faces and being interposed between said contact faces, thereby while covering said first folding face and while sliding over said first folding face the first blank leg is folded by being mainly supported simultaneously on said plurality of finely distributed contact faces and being substantially unsupported by said directly interconnected face sections.

4. The apparatus according to claim 2, wherein said two separate folding flap are folded with respect to each other and with respect to the second blank leg simultaneously with a conveying motion of the sheet blank, wherein said folding gap is provided for guiding and folding the interconnected folding flaps in cross-section transverse to said conveying motion, said folding gap providing interconnected flap gap sections reciprocally oriented at an obtuse angle, said flap gap sections being interconnected at a folding point and defining gap width extensions, said gap width extensions of said flap gap sections being substantially constant up to said folding point.

5. The apparatus according to claim 2, comprising a leg gap section having leg gap boundaries for guiding the second blank leg at an angle with respect to the two separate folding flaps while said two separate folding flaps are alternately and oppositely folded into a folded Z-shape, said leg gap section defining a leg width extension substantially equal to said gap width extension of said flap gap sections, said leg gap section connecting to a gap extension of said folding gap substantially at right angles.

6. The apparatus according to claim 2, further comprising:

said plurality of folding faces of said at least one guiding tool being spaced from each other downstream with respect to a conveying motion, wherein the sheet blank being folded while being continuously conveyed in said conveying motion past said plurality of folding faces of said at least one guiding tool; and, first and second tool bodies, said plurality of folding faces of said at least one guiding tool being provided on said first tool body, said first tool body being separably and exchangeably mounted on said second tool body together with said plurality of folding faces of said at least one guiding tool, said second tool body including a support face for contacting the second blank leg.

7. The apparatus according to claim 2, wherein said limited folding faces include two inner and outer guiding face sections reciprocally oriented at an angle when seen parallel to said conveying motion, only said inner guiding face section engaging and guiding the shorter folding flap continuously in the erected position and substantially without folding action, said inner guiding face section also engaging and guiding the higher folding flap continuously in the erected position but only over a flap section of the longer flap height extension while said two inner and outer guiding face sections, including folding face sections, fold the higher folding flap directly adjacent to the flap section to provide a Z-shaped gusset as the blank is conveyed.

8. The apparatus according to claim 2, wherein juxtaposed separate guiding tools are provided for substantially simultaneously producing at least two separate folded products from juxtaposed separate sheet blanks in a common conveying motion and when the separate sheet blanks are reciprocally laterally juxtaposed transverse to said conveying motion and to a median plane, said median plane is oriented parallel to said conveying motion and located between said sheet blanks and said production line means.

9. The apparatus according to claim 8, for simultaneously folding the separate sheet blanks when the second blank legs of the separate sheet blanks are located substantially in a common blank plane, wherein each of said juxtaposed separate guiding tools comprises a folding tool body commonly having at least two separate first folding faces for simultaneously folding the two separate sheet blanks, said two separate first folding faces defining folding pitches oppositely oriented when seen parallel to said conveying motion and in a downstream direction, downstream ends of each said first folding faces being located on remote sides of said folding tool body.

10. The apparatus according to claim 2, wherein;

along a conveying path for the at least one sheet blank which is parallel to the conveying motion, said at least one guiding tool erects the first blank leg with respect to the second blank leg, then folds the first blank leg onto the second blank leg and then presses the first blank leg onto the second blank leg, connecting to a first longitudinal blank edge of the second blank leg; and, an other guiding tool erects, folds and presses the first blank leg connecting to a second longitudinal blank edge of the second blank leg, the second blank edge being located remote from the first blank edge and defining a folding zone, with respect to said apparatus base and said at least one guiding tool and said other guiding tool being mounted positionally adjustable in a direction transverse to said conveying path and said folding zone but parallel to the second blank leg.

11. The apparatus according to claim 2, wherein at least one preassembled tool unit is provided, parallel to a conveying motion of the sheet blank said tool unit including following folding sections for prefolding, supplementally folding and press folding the first blank leg onto the second blank leg, said tool unit further including opposing guiding faces bounding a guiding gap for guiding the second blank leg, said preassembled tool unit being separable from said apparatus base.

12. The apparatus according to claim 11, wherein said at least one preassembled tool unit comprises said at least one guiding tool and an other guiding tool for folding the first blank legs on remote longitudinal sides of the sheet blank, said apparatus base including an insertion trolley for commonly inserting and removing said at least one and an other guiding tools on a top of a base providing a support means for direct support on a foundation floor and for indirectly supporting said at least one and an other guiding tools first with respect to the foundation floor, at least one of said guiding tools including a guiding gap for supportingly guiding the second blank leg.

13. The apparatus according to claim 12, wherein said insertion trolley is insertable and removable on said top of said base in at least one of a direction transverse to said conveying motion, a substantially horizontal direction, and a direction substantially parallel to a median gap plane of said guiding gap.

14. The apparatus according to claim 12, wherein said apparatus base is subdivided into two separate and individually preassembled first and second base units, said insertion trolley being provided by said first base unit and said second base unit being superimposed on said insertion trolley while including said at least one preassembled tool unit.

15. The apparatus according to claim 2, comprising at least one tool unit along a said conveying motion of the at least one sheet blank and extending from a unit beginning to a unit end, between said unit beginning and said unit end said at least one tool unit including following folding sections for erecting, z-folding and crease folding the first blank leg into two superimposed leg layers on the second blank leg, said unit beginning being spaced from said unit end by an operational length, said at least one guiding tool and an other guiding tool including laterally outermost guiding faces for said at least one sheet blank, said outermost guiding faces defining an operational width of said apparatus, said operational length being smaller than said operational width.

16. The apparatus according to claim 1, wherein each of said contact protrusions includes only one of said individual contact faces, thereby reducing said sliding friction by providing air cushioning between said contact faces for the first blank leg.

17. The apparatus according to claim 16, wherein: p1 said individual contact faces are line-shaped and extend transverse to said conveying direction; and, codirectional with said conveying directions, said contact faces rise by a folding pitch gradient, at least one of said individual contact faces being oriented substantially planar in cross-section.

18. The apparatus according to claim 2, wherein said first folding face is provided by an angularly stepped curve including juxtaposed partial surfaces, one of said contact faces being formed between each of said juxtaposed partial surfaces, said contact faces being line-shaped.

19. The apparatus according to claim 1, wherein said limited folding faces comprise circumferential folding faces of separate and individual first and second folding rollers for engaging and folding the first blank leg, said circumferential folding faces being inherently dimensionally substantially stiff and said folding rollers being mounted to perform folding rotations while folding the first blank legs about at least one folding zone oriented substantially parallel to a conveying motion of the sheet blank, said circumferential folding faces, when seen parallel to said conveying motion, complementarily interengaging to opposingly bound said a folding gap.

20. The apparatus according to claim 19, wherein said folding gap is V-shaped and includes gap legs, said gap legs being oriented at an obtuse angle with respect to one another, said circumferential folding faces of each of said gap legs being oriented parallel to one another when seen parallel to said conveying motion.

21. The apparatus according to claim 19, having a conveying plane for conveying the second blank leg, wherein said folding rollers rotate about axes oriented substantially at right angles to said conveying plane, said circumferential folding faces of said second folding roller bounding a V-shaped annular depression and directly interconnecting at a sharp corner depression bottom, said circumferential folding faces of said first folding roller bounding a V-shaped annular protrusion and directly interconnecting at a sharp cornered protrusion peak.

22. The apparatus according to claim 19, wherein:

said folding gap includes gap ends bounded by said folding rollers; and, when seen parallel to said conveying motion, at least one of said gap ends connecting to a stationary extension gap bounded by stationary opposing gap faces which guide said first blank leg.

23. The apparatus according to claim 1, wherein downstream of said third folding face the shorter folding flap is supplementally folded by said second folding face whereby means are provided for transferring the shorter folding flap from the third folding face to the second folding face by a jumping motion, said third folding face being entirely separate from said second folding face.

24. The apparatus according to claim 1, further, comprising:

a common tool body, said at least one guiding tool disposed on said common tool body and comprising respective of said plurality of folding faces for simultaneously folding two products from separate sheet blanks, said respective folding faces being provided on remote sides of said tool body and a median plane oriented parallel to the conveying motion; and, said tool body forming, together with said respective folding faces, a mounting unit exchangeably mounted on said apparatus base, said apparatus base including a guide face for guiding the second blank leg in a blank plane.

* * * * *